United States Patent [19]

Roodbergen

[11] 4,425,034

[45] Jan. 10, 1984

[54] SYSTEM FOR SUPPRESSING VIBRATIONS OF A PHOTOCONDUCTIVE BELT IN A PROCESSING ZONE OF AN ELECTROSTATIC COPYING MACHINE

[75] Inventor: Sake P. Roodbergen, Tegelen, Netherlands

[73] Assignee: Océ-Nederland B.V., Venlo, Netherlands

[21] Appl. No.: 347,040

[22] Filed: Jan. 22, 1982

[30] Foreign Application Priority Data

Feb. 18, 1981 [NL] Netherlands ..... 8100782

[51] Int. Cl.[3] ..... G03G 15/00

[52] U.S. Cl. ..... 355/3 BE; 355/16; 198/837; 198/841

[58] Field of Search ..... 355/3 BE, 16; 271/275, 271/271, 274, 198; 198/837, 841, 811; 226/196; 242/76

[56] References Cited

U.S. PATENT DOCUMENTS

| | | | |
|---|---|---|---|
| Re. 27,313 | 3/1972 | Jones et al. . | |
| 3,796,488 | 3/1974 | Tanaka . | |
| 3,836,245 | 9/1974 | Hastwell et al. . | |
| 3,931,940 | 1/1976 | Raighn et al. | 242/66 X |
| 3,973,846 | 8/1976 | Sullivan et al. | 355/16 |
| 4,008,801 | 2/1977 | Reilly et al. | 198/841 |
| 4,183,658 | 1/1980 | Winthaegen | 355/16 X |
| 4,314,696 | 2/1982 | Graef | 271/275 |

*Primary Examiner*—Richard L. Moses

*Attorney, Agent, or Firm*—Albert C. Johnston; Louis H. Reens

[57] ABSTRACT

Vibrations in a taut flight of a photoconductive belt moving through the image projection zone or another processing zone of an electrostatic copying machine are suppressed by means of a closed flat plate surface disposed parallel to the belt flight at a small distance therefrom, such as a distance of 1 to 2 millimeters.

4 Claims, 1 Drawing Figure

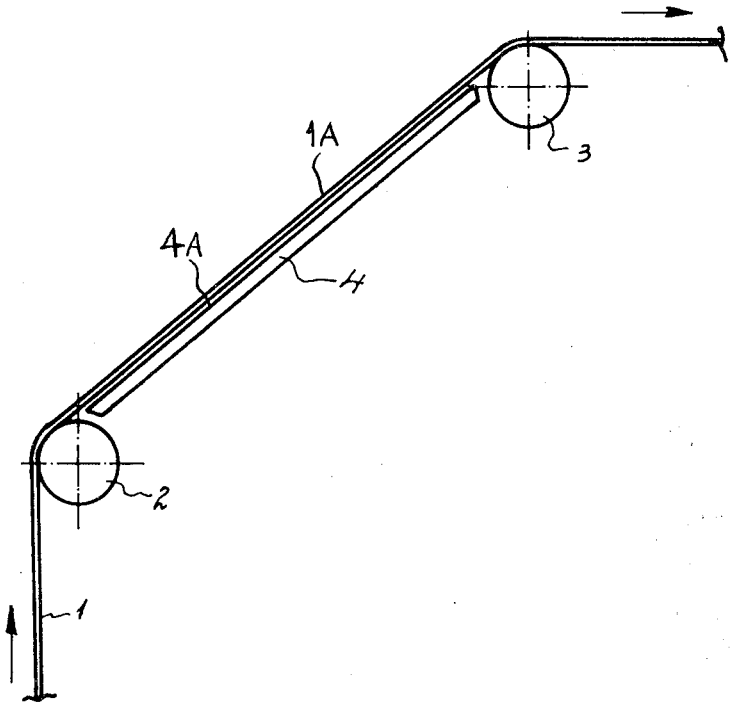
1A
4A
4
3
2
1

SYSTEM FOR SUPPRESSING VIBRATIONS OF A PHOTOCONDUCTIVE BELT IN A PROCESSING ZONE OF AN ELECTROSTATIC COPYING MACHINE

This invention relates to a system for suppressing vibrations in a flight of a photoconductive belt moving through a processing zone of an electrostatic copying machine while being guided and held taut between guide members arranged at opposite sides of the processing zone.

Electrostatic copying machines making use of a photoconductive belt for the image formation are advantageous in that, among other things, with the use of flash lamps and a lens, an image of an original placed on an exposure window for being photocopied can be projected integrally onto a flat section of the belt while the belt is being moved through the projection zone. With an appropriate selection of the belt speed and the number of flash exposures per unit of time, a machine of this type can produce copies at a high rate of, for example, 60 to 120 copies a minute.

In order to minimize the electrical power consumption of the lamps at such a high rate of copy production, a projection lens having a large relative aperture preferably will be used. Such a lens, however, has a small depth of field, as a result of which it is especially important in its use to maintain the belt flat and in proper position in the projection zone. Even slight vibrations in the exposed section of the belt, such for example as a vibration having an amplitude of one to a few millimeters, may cause the belt section at the moment of flash exposure to be displaced from the optimal image plane so far that the quality of the projected image is objectionably impaired.

Vibrations in the photoconductive belt may also be objectionable in processing zones of a copying machine other than the image projection zone, such as in a charging zone or a developing zone where vibrations may give rise to uneven charging or streaky development of the belt.

It is known to suppress vibrations in a flight of the belt being moved through a processing zone between two guide rollers, for example as disclosed in Dutch patent application No 6907842, by directing the belt in the processing zone over a perforated wall of a suction box. As a result of the partial vacuum in the suction box, the belt is pressed into intimate contact with the perforated wall and thus is maintained perfectly flat as it is being moved.

It is also known, as disclosed in U.S. Pat. No. 3,796,488, to move the belt over a flat plate supporting the belt; and also, as disclosed in U.S. Pat. No. 3,836,245, to tension the belt over a perforated plate connected with an air pump which forces air through the perforations and between the belt and the plate to advance the moving belt, in a manner of speaking, on a continually replenished layer of air.

Although the belt can be kept perfectly flat by use of these known expedients, their practical application, even so, is disadvantageous in important respects. On the one hand, the use of air pumps and perforated plates is relatively expensive, and the air displacement effected by such means produces disturbing noise. On the other hand, the friction between the belt and a flat plate supporting it causes wear of the belt; and this in turn will result in contamination in the machine and possibly also in clogging of a perforated belt supporting wall.

The object of the present invention is to provide a simple system by which vibration of a tensioned flight of a photoconductive belt being moved through a processing zone between belt guiding members can be suppressed with avoidance of undesired wear of the belt and contamination of the copying machine.

According to the invention, it has been found that this object can be achieved by providing in parallel relation to the belt flight in the processing zone a flat, rigid closed plate surface having dimensions corresponding substantially to those of the processing zone and spaced from the belt flight at a distance sufficiently small that vibrations in the belt being moved through the processing zone are suppressed. Thus, the belt of a flight held flat by tension between guide members located at opposite sides of a processing zone is moved through the processing zone on a thin, relatively dormant layer of air constrained between the belt and the flat plate surface, as a result of which vibrations in the belt flight are suppressed noiselessly and without exertion of friction on the belt.

By the system of this invention, which indeed is quite simple, surprisingly good results have been obtained. The results are attributable to the thin layer of air present between the belt and the plate surface, which layer prevents the belt from contacting the plate and, additionally, is so constrained that it functions as an excellent air damper. An effectively small distance between the belt and the plate surface can be easily determined and maintained, its exact value being not very critical if kept within several millimeters. Extremely good results have been obtained in many cases with this distance set in the range of 1 to 2 mm.

The invention is illustrated schematically in the accompanying drawing.

As shown in the drawing, a photoconductive belt 1 in an electrostatic copying machine is tensioned over guide rollers 2 and 3 between which a flight 1A of the belt extends through a processing zone, such for instance as the image projection zone, of the machine (not otherwise shown). The belt is driven in the direction indicated by an arrow, and the flight 1A is held flat by the tension on the belt. The tension can be applied in well known manner, for instance as disclosed in U.S. Pat. No. 3,846,021.

A rigid plate 4 having a closed flat surface 4A is disposed along and over nearly the entire area of the back side of the belt flight 1A between the guide rollers 2 and 3, with the plate surface 4A lying parallel to and at a distance of 1–2 mm from the belt.

In an arrangement of the type illustrated, making use of a polyester belt 430 mm wide and 0.1 mm thick coated with a photoconductive layer, but without use of a rigid closed plate according to the invention, vibrations having a maximum amplitude of 1 mm were detected when the belt was moved at a speed of 500 mm per second over two guide rollers spaced apart at a distance of 300 mm from each other. When the same arrangement was provided with a closed flat plate surface disposed at a distance of 1 mm from the belt according to the invention, only a negligible vibration having a maximum amplitude of 0.1 mm could be detected.

What is claimed is:

1. In an electrostatic copying machine comprising a photoconductive belt movable through a processing